US011793332B2

(12) United States Patent
Mazingue et al.

(10) Patent No.: US 11,793,332 B2
(45) Date of Patent: Oct. 24, 2023

(54) MOUNTING BRACKET FOR SECURING OBJECTS TO WALLS OR OTHER SURFACES

(71) Applicant: Premier Glass Products, LLC, Atlanta, GA (US)

(72) Inventors: Alexis M. Mazingue, Baton Rouge, LA (US); Brian Stanley Ozment, Atlanta, GA (US)

(73) Assignee: Premier Glass Products, LLC, Atlanta, GA (US)

( * ) Notice: Subject to any disclaimer, the term of this patent is extended or adjusted under 35 U.S.C. 154(b) by 0 days.

(21) Appl. No.: 17/389,429

(22) Filed: Jul. 30, 2021

(65) Prior Publication Data

US 2023/0018156 A1 Jan. 19, 2023

Related U.S. Application Data

(60) Provisional application No. 63/223,286, filed on Jul. 19, 2021.

(51) Int. Cl.
*A47G 1/21* (2006.01)

(52) U.S. Cl.
CPC ..... *A47G 1/215* (2013.01)

(58) Field of Classification Search
CPC ..... A47G 1/16; A47G 1/1606; A47G 1/1613; A47G 1/162; A47G 1/1626; A47G 1/1633;

(Continued)

(56) References Cited

U.S. PATENT DOCUMENTS 1,407,177 A * 2/1922 Stone ..... A47G 1/215 248/490
2,185,084 A * 12/1939 Hutaff, Jr. ..... B60R 13/105 248/316.5

(Continued)

FOREIGN PATENT DOCUMENTS

DE 3805511 A1 * 8/1989 ..... A47G 1/10

OTHER PUBLICATIONS

NOVICA, NOVICA Purple and Green Reverse Painted Glass Frame Rectangular Wall Mounted Mirror, Colorful Reflection, Mar. 9, 2017, https://www.amazon.com/NOVICA-Reverse-Rectangular-Colorful-Reflection/dp/B06XHPLVNM. (Year: 2017).*

(Continued)

*Primary Examiner* — Jonathan Liu
*Assistant Examiner* — Guang H Guan
(74) *Attorney, Agent, or Firm* — Thomas | Horstemeyer, LLP

(57) ABSTRACT

A wall-mounting bracket is described that includes a base comprising a base body and a cover detachably attachable to the base body. The base body includes a back plate configured to be positioned against a wall; a first bend and a second bend defining a first recess for receiving a first side of a decorative item to be secured to the wall, defining a first lip for retaining the first side of the decorative item; a third bend and a fourth bend defining a second recess for receiving a second side of the decorative item to be secured to the wall, defining a second lip for retaining the second side of the decorative item, where the second recess is perpendicular to the first recess; and an aperture in the back plate having a recessed lip through which a mounting device may be positioned.

15 Claims, 11 Drawing Sheets

(58) Field of Classification Search
CPC ..... A47G 1/164; A47G 1/1646; A47G 1/20; A47G 1/21; A47G 1/215; A47G 1/10; A47G 1/101; A47G 1/102; A47B 97/04; A47B 95/043; A47B 2095/046
USPC ..... 248/488, 490, 345.1
See application file for complete search history.

(56) References Cited

U.S. PATENT DOCUMENTS 2,204,862 A * 6/1940 Lehman ..... A47G 1/215 40/785
2,328,252 A * 8/1943 Barker ..... B60R 13/105 40/210
3,009,275 A * 11/1961 Rosenberg ..... A47G 1/0644 248/490
3,203,142 A * 8/1965 Narmore ..... A47K 1/08 248/490
3,347,504 A * 10/1967 Goss ..... A47G 1/215 248/301
D221,958 S * 9/1971 Finebaum ..... D8/403
3,829,054 A * 8/1974 Heilmeier ..... A47G 1/0638 248/490
3,854,259 A * 12/1974 Lechene ..... E04B 1/6112 52/704
4,019,270 A * 4/1977 Trowbridge ..... G09F 1/12 40/741
4,072,231 A * 2/1978 Helms ..... B65D 81/056 217/53
4,179,089 A * 12/1979 Parr, Jr. ..... A47G 1/215 248/216.1
D259,083 S * 5/1981 Riegsecker ..... A47G 1/215 D8/382
D260,590 S * 9/1981 Hobson ..... A47G 1/215 D8/403
4,394,000 A * 7/1983 Kurtz ..... A47G 1/215 248/488
4,629,152 A * 12/1986 Spilka ..... A47G 1/0638 248/490
4,703,569 A * 11/1987 Bowman ..... G09F 15/02 40/792
5,285,994 A * 2/1994 Wang ..... A47G 1/215 248/488
5,295,651 A * 3/1994 Baker, Jr. ..... A47G 1/215 248/488
5,337,988 A * 8/1994 Kurtz ..... A47G 1/215 248/495
5,735,068 A * 4/1998 Houssian ..... A47G 1/10 40/784
5,783,281 A * 7/1998 Man ..... G09F 7/06 428/126
5,799,429 A * 9/1998 Speshyock ..... A47G 1/0638 40/778
D481,304 S * 10/2003 Drake ..... D8/403
6,647,652 B1 * 11/2003 Seiber ..... G09F 7/18 434/414
D537,337 S * 2/2007 Brockington ..... A47G 1/0638 D8/499
7,350,646 B2 * 4/2008 Durrant ..... B65D 81/057 206/453
7,380,765 B2 * 6/2008 Shift ..... A47B 97/04 248/460
10,039,394 B2 * 8/2018 Pyle ..... A47G 1/10
10,117,531 B1 * 11/2018 Hoban ..... A47G 1/0638
10,595,651 B2 * 3/2020 Soto ..... F16B 47/003
D936,473 S * 11/2021 Huang ..... D8/403
D953,854 S * 6/2022 Yoon ..... D8/403
2007/0138041 A1 * 6/2007 Welsh ..... B25H 3/02 206/349
2022/0248878 A1 * 8/2022 Holmes ..... A47G 1/0627
2023/0018156 A1 * 1/2023 Mazingue ..... A47G 1/215

OTHER PUBLICATIONS

Amazon.com, "Search Results for 'Picture Frame Corner Brackets'," Various Sellers (Last Visited: Jul. 19, 2021).
Amazon.com, "Mirror Fastening Comer Bracket Clip Mounting Clamp CP + Screws," Seller: Direct Hardware (Last Visited: Jul. 19, 2021).

* cited by examiner

FIG. 12A
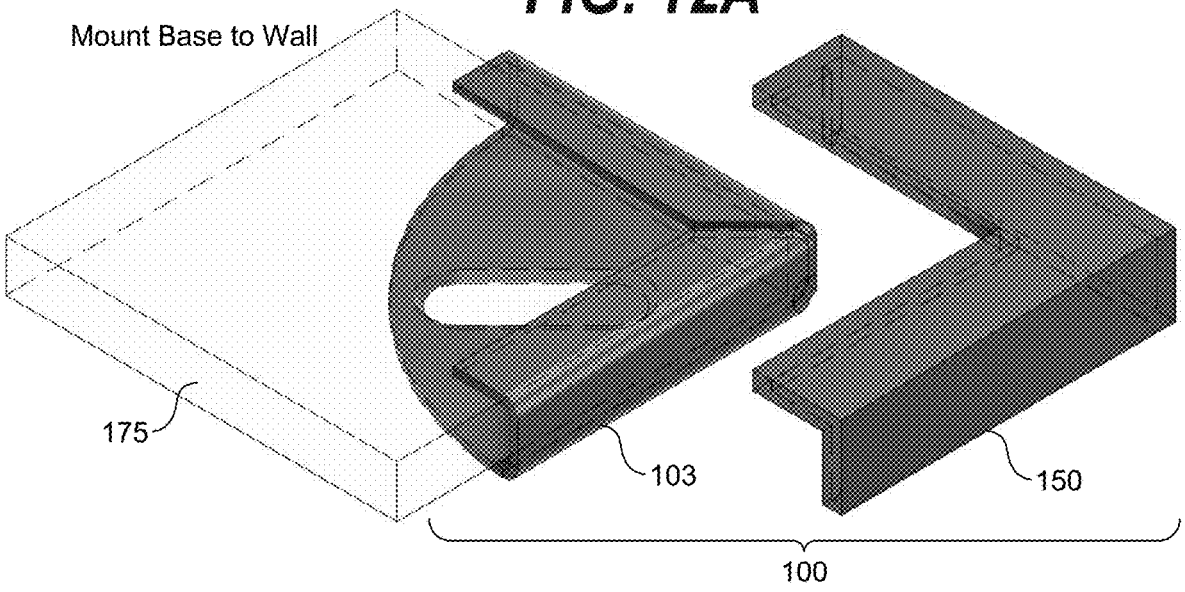
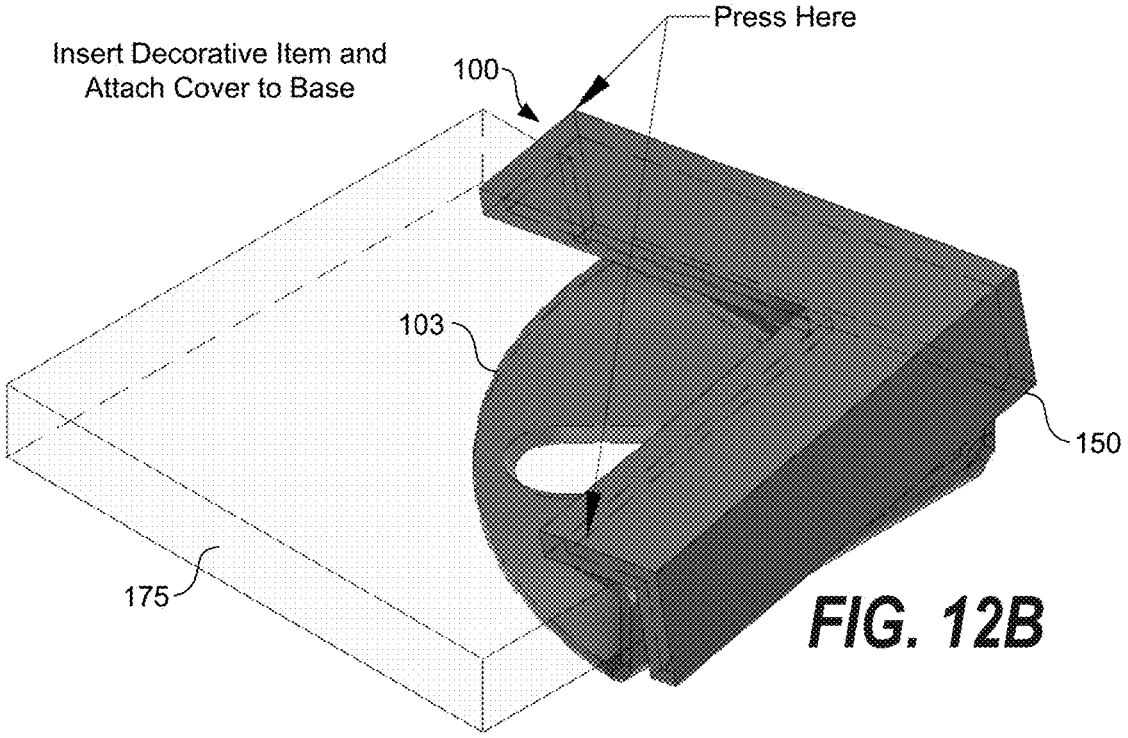
FIG. 12B

MOUNTING BRACKET FOR SECURING OBJECTS TO WALLS OR OTHER SURFACES

CROSS-REFERENCE TO RELATED APPLICATION

This application claims the benefit of and priority to U.S. Provisional Application No. 63/223,286 entitled "MOUNTING BRACKET FOR SECURING OBJECTS TO WALLS OR OTHER SURFACES," filed Jul. 19, 2021, the contents of which being incorporated by reference in their entirety herein.

BACKGROUND

Currently, decorative glass and other heavy display items are coupled to a wall for display using adhesives, edge clips or channels, or standoffs. Adhesives are known to leave residue and potentially impair the decorative item. Standoffs require a connection with a glass, such as through an aperture cut in the glass requiring the display item to be pre-cut prior to installation. As such, corner brackets tend to be desirable for mounting heavy items, such as mirrors or decorative glass, to walls and other surfaces. Today, corner brackets are not aesthetically pleasing, having screws that are in sight while requiring eight or sometimes more screws to mount an item to a wall.

BRIEF SUMMARY OF THE INVENTION

The present disclosure relates to a mounting bracket for securing objects to walls or other desired surfaces. More specifically, a wall-mounting bracket is described that includes a base comprising a base body and a cover detachably attachable to the base body. The base body includes a back plate configured to be positioned against a wall; a first bend and a second bend defining a first recess for receiving a first side of a decorative item to be secured to the wall, defining a first lip for retaining the first side of the decorative item; a third bend and a fourth bend defining a second recess for receiving a second side of the decorative item to be secured to the wall, defining a second lip for retaining the second side of the decorative item, where the second recess is perpendicular to the first recess; and an aperture in the back plate having a recessed lip through which a mounting device may be positioned.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIGS. 12A-C show an example of attaching a cover to a base shown relative to a decorative item to be secured to a wall or other surface in accordance with various embodiments of the present disclosure.

DETAILED DESCRIPTION

The present disclosure relates to a mounting bracket for securing objects to walls or other desired surfaces. Corner brackets tend to be desirable for mounting heavy items, such as mirrors or decorative glass, to walls and other surfaces. Today, corner brackets are not aesthetically pleasing, having screws that are in sight while requiring eight or sometimes more screws to mount an item to a wall.

Accordingly, a wall-mounting bracket is described that includes a base comprising a base body and a cover detachably attachable to the base body. The cover may be a decorative cover that forms a snap connection with the base body to cover partially or entirely the base body. The base body includes a back plate configured to be positioned against a wall; a first bend and a second bend defining a first recess for receiving a first side of a decorative item to be secured to the wall, defining a first lip for retaining the first side of the decorative item; a third bend and a fourth bend defining a second recess for receiving a second side of the decorative item to be secured to the wall, defining a second lip for retaining the second side of the decorative item, where the second recess is perpendicular to the first recess; and an aperture in the back plate having a recessed lip through which a mounting device may be positioned.

As may be appreciated, the base may retain or secure the decorative item by its corner onto a wall or other desired surface. A decorative item may be installed by mounting bottom corner brackets with a screw in the respective apertures. From there the decorative item is stationary, as the two bottom corner brackets are stationary. The top corner mounting brackets are attached via the aperture, but can slide out of the way to insert the mirror, glass, painting, or other decorative item. Once the decorative item is secured in the bottom using the bottom mounting brackets, the top mounting brackets can slide down via the aperture. The decorative item is then secured from tilting forward. Decorative covers can be snapped into place to cover the base and the corner of the decorative item. The decorative covers may have varying designs, colors, materials, or other options, as may be appreciated.

Figure 1:
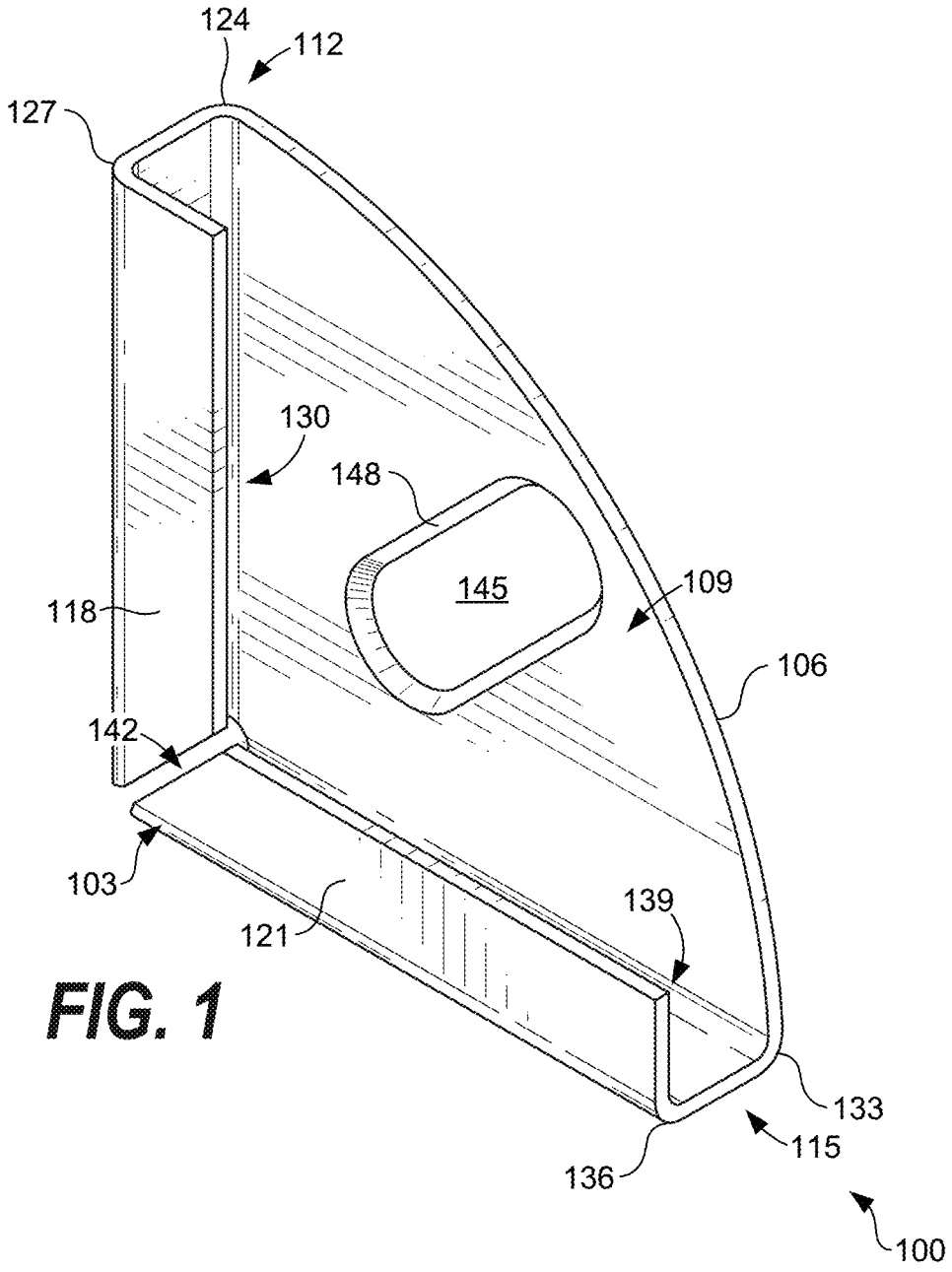
FIG. 1 is a top perspective view of a base of a wall-mounting bracket in accordance with various embodiments of the present disclosure.
Figure 2:
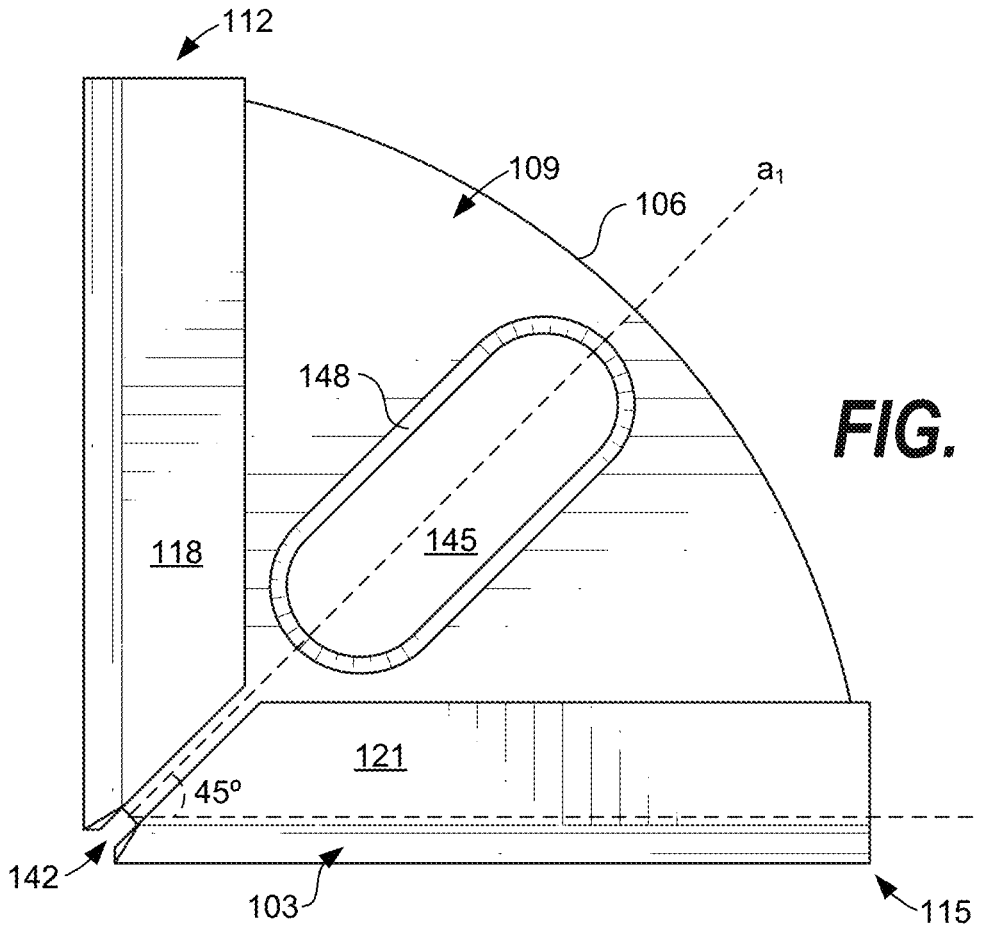
FIG. 2 is a front elevation view of a base of the wall-mounting bracket in accordance with various embodiments of the present disclosure.
Figure 3:
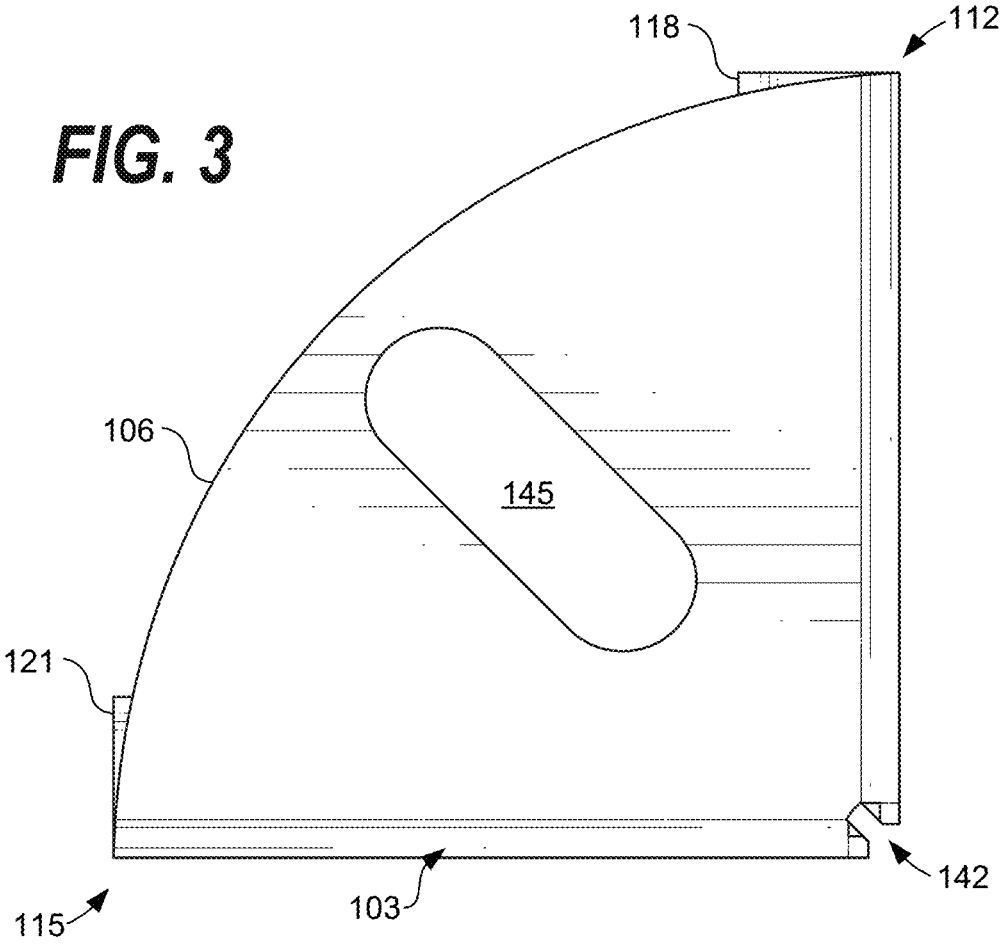
FIG. 3 is a rear elevation view of a base of the wall-mounting bracket in accordance with various embodiments of the present disclosure.
Figure 4:
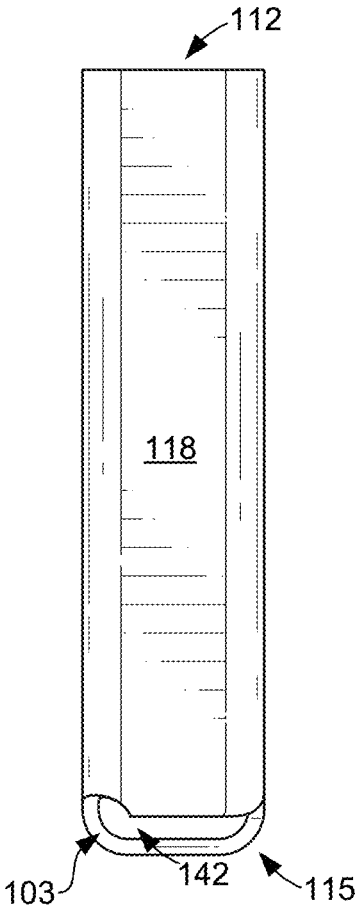
FIG. 4 is a first side view of a base of the wall-mounting bracket in accordance with various embodiments of the present disclosure.
Figure 5:
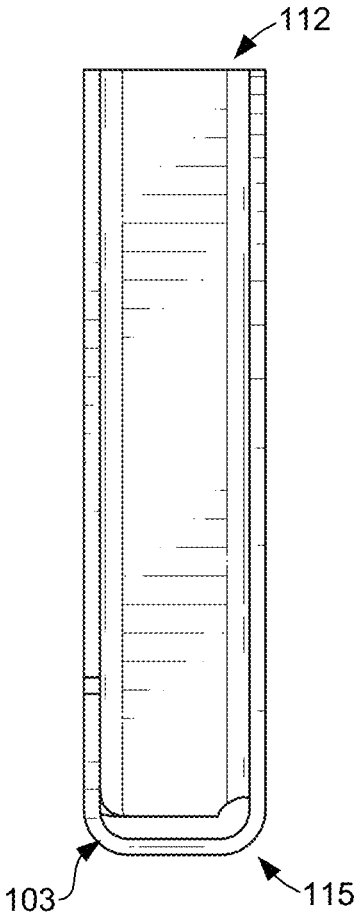
FIG. 5 is a second side view of a base of the wall-mounting bracket opposite that of FIG. 4 in accordance with various embodiments of the present disclosure.
Figure 6:
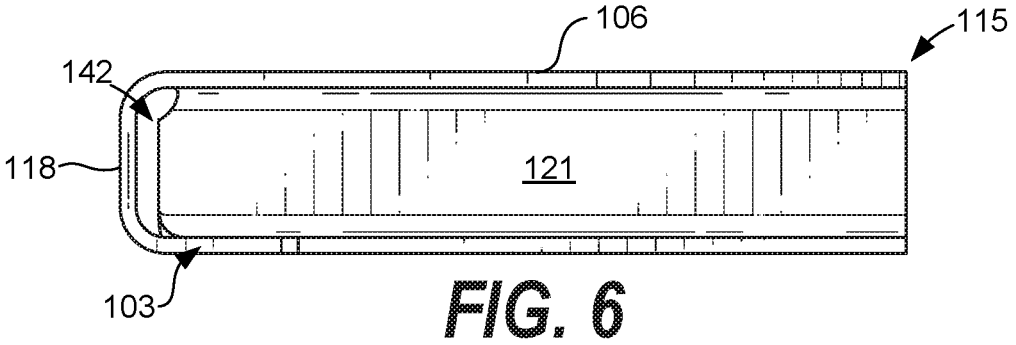
FIG. 6 is a top view of a base of the wall-mounting bracket in accordance with various embodiments of the present disclosure.
Figure 7:
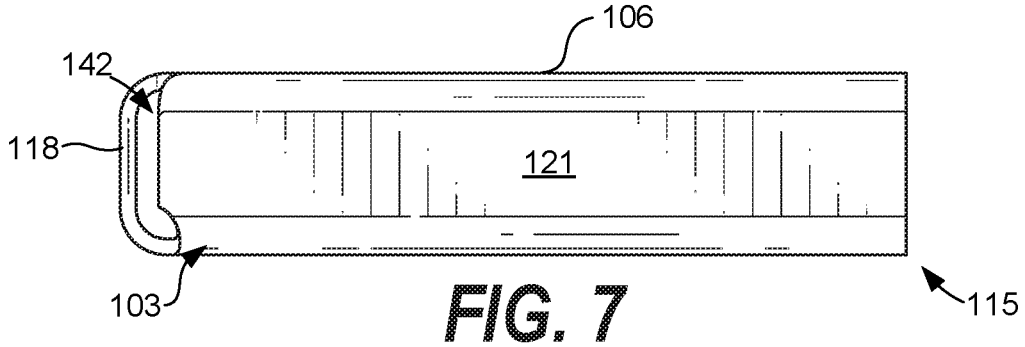
FIG. 7 is a bottom view of a base of the wall-mounting bracket opposite that of FIG. 6 in accordance with various embodiments of the present disclosure.

Turning now to the drawings, FIG. 1 is a top perspective view of a base of a wall-mounting bracket, FIG. 2 is a front elevation view thereof, FIG. 3 is a rear elevation view thereof, FIG. 4 is a first side view thereof, FIG. 5 is a second side view thereof, FIG. 6 is a top view thereof, and FIG. 7 is a bottom view thereof.

Referring to FIGS. 1-7 collectively, a non-limiting example of a wall-mounting bracket 100 is shown, where the wall-mounting bracket 100 may include a base 103 and a cover (not shown). Referring first to the base 103, the base 103 includes a base body 106. The base body 106 may include a back plate 109 configured to be positioned against a wall (not shown). In some embodiments, the back plate 109 may include a curved portion extending in an annular fashion between a top end 112 and a bottom end 115 of the back plate 109, although other shapes and sizes may be employed other than the non-limiting example shown in FIG. 1.

Further, the base 103 may include a first lip 118 and a second lip 121, for example. The first lip 118 may be configured to secure and retain a first side (e.g., a left side) of a decorative item to a wall or other surface, whereas the second lip 121 may be configured to secure and retain a second side (e.g., a bottom side) of the decorative item to a wall or other surface, for instance. In some embodiments, the first lip 118 and the second lip 121 are integral with the base 103 and/or the back plate 109 (e.g., the first lip 118 and the second lip 121 may be formed of a single piece of material and the same material as the back plate 109). In other embodiments, the first lip 118 and the second lip 121 may be coupled to the base 103 and/or the back plate 109 through welding, adhesives, or other suitable connection mechanisms.

To this end, in some embodiments, the base 103 includes a first bend 124 and a second bend 127 defining a first recess 130 for receiving a first side of a decorative item to be secured to the wall. Additionally, by virtue of the second bend 127, the first bend 124 and the second bend 127 define the first lip 118 for securing and/or retaining the first side of the decorative item. Similarly, in some embodiments, the base 103 further includes a third bend 133 and a fourth bend 136 defining a second recess 139 for receiving a second side of the decorative item to be secured to the wall. Also similarly, by virtue of the fourth bend 136, the third bend 133 and the fourth bend 136 define the second lip 121 for securing and/or retaining the second side of the decorative item.

As shown in FIG. 1, the second recess 139 is perpendicular to the first recess 130. This may be the case by virtue of the first lip 118 being perpendicular to the second lip 121. In some embodiments, the first lip 118 and the second lip 121 connect; however, in alternative embodiments, as shown in FIG. 1, a space 142 (e.g., an angled space) may be positioned or exist between the first lip 118 and the second lip 121. In some embodiments, the space 142 permits expansion of at least one of the first lip 118 and the second lip 121.

Further, in some embodiments, the base body 106 and, more specifically, the back plate 109, includes an aperture 145 configured to receive a mounting device (e.g., a nail or a screw) to secure the base body 106 and/or the back plate 109 thereof to a wall or other suitable surface. In some embodiments, the aperture 145 is an elongated aperture positioned on the back plate 109 of the base body 106. Further, in some embodiments, the aperture 145 is nested in a front surface of (shown in FIG. 1, where a rear surface is shown in FIG. 3) the back plate 109 or, in other words, has a recessed lip 148. The recessed lip 148 assists with maintaining a screw head or other projection in the aperture 145 while allowing the screw to retain the base body 106 to a wall or other surface. Further, the recessed lip 148 assists with the screw head or other projection from scratching a rear surface of a decorative item.

In some embodiments, such as those in which the aperture 145 is elongated, the aperture 145 may be angled at and extend along an axis $a_1$ at a predetermined angle (e.g., forty-five degrees or other desirable angle) from a bottom corner of the base 103, where the bottom corner is defined as the area of an intersection of the first lip 118 and the second lip 121 or, more specifically an area of the space 142 if the first lip 118 and the second lip 121 do not connect. Further, the aperture 145 may have rounded corners in some examples.

While FIGS. 1-7 show the first lip 118 being perpendicular to the second lip 121, thereby forming a sharp cover to mate flush with a sharp corner of a decorative item to be hung, in alternative embodiments, the first lip 118 and the second lip 121 may be sized and positioned to form a rounded shape corner or other desirable shape, such as instances in which it is desirable to mount a circular object, such as circular glass or a circular mirror.

Figure 8:
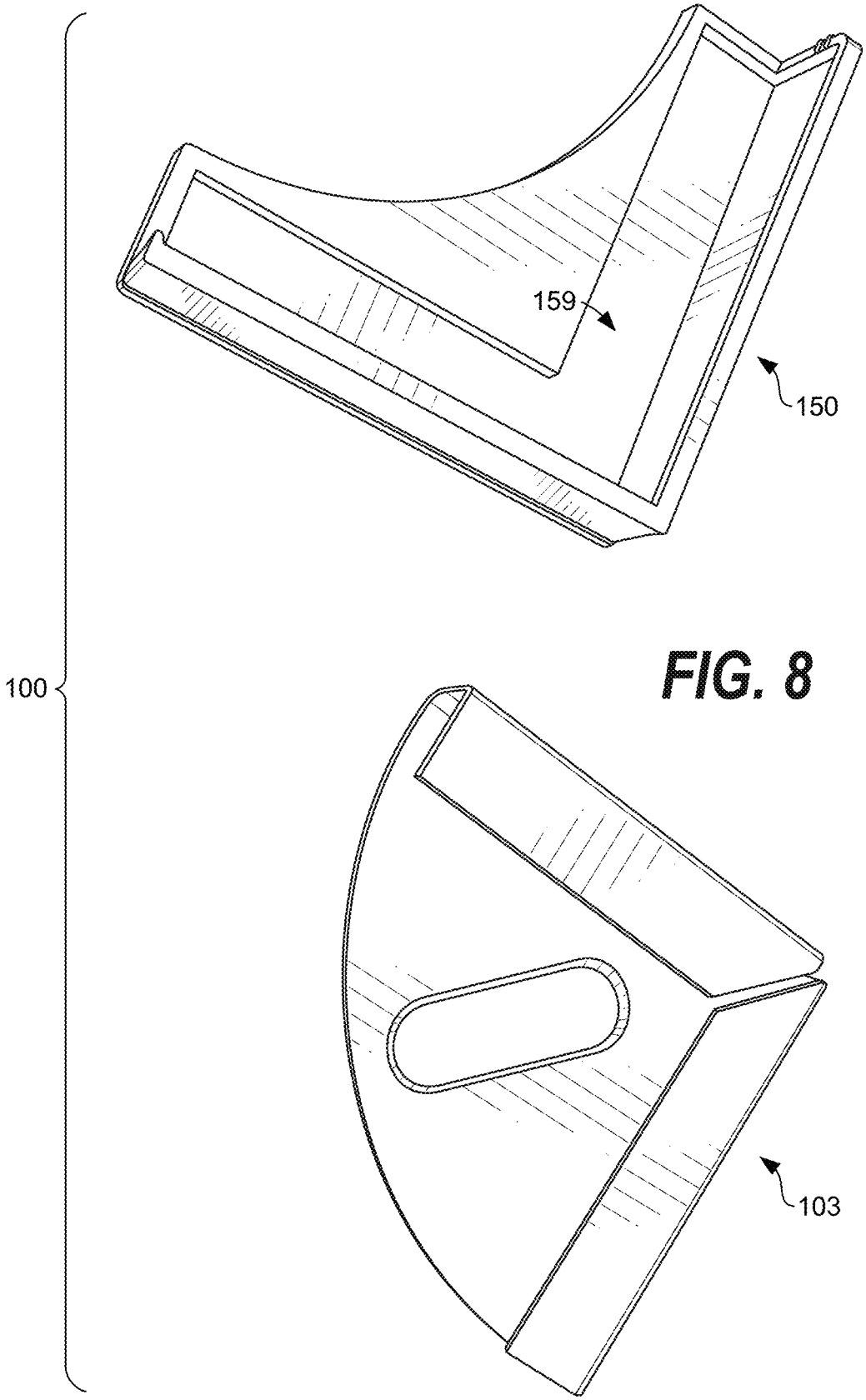
FIG. 8 is a perspective view of a base and a cover of the wall-mounting bracket in accordance with various embodiments of the present disclosure.
Figure 9:
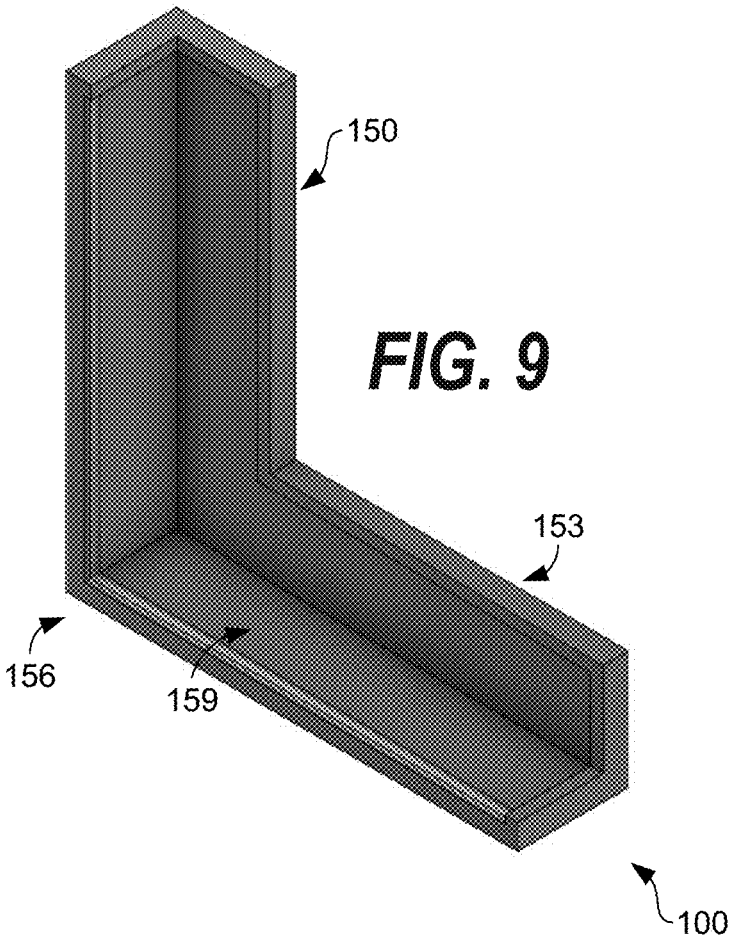
FIG. 9 is a perspective view of the cover of the wall-mounting bracket in accordance with various embodiments of the present disclosure.

Turning now to FIG. 8, a perspective view of the base 103 is shown relative to a cover 150 of the wall-mounting bracket 100 in accordance with various embodiments of the present disclosure. FIG. 9 is a perspective view of the cover 150 of the wall-mounting bracket in accordance with various embodiments of the present disclosure. Referring collectively to FIGS. 8 and 9, the cover 150 may be detachably attached or, in other words, removably attached to the base 103 or the base body 106 through an interference connection, a friction connection, a snap connection, or a combination thereof. In embodiments in which a snap connection is employed, at least a portion of the cover 150 may be formed of a material that permits the cover to expand sufficiently to form the snap connection with the base body 106.

In addition or in lieu of the foregoing, in some embodiments, the cover 150 may be attached or further secured using screws or another desirable connection mechanism. In some embodiments, the cover 150 is sized and positioned to cover an entirety of the base 103 or the base body 106 such that the base 103 or the base body 106 cannot be seen when a decorative item is hung or otherwise installed.

In some embodiments, the cover 150 may include a front surface 153 configured to face outwards when installed and a rear surface 156 configured to face inwards and abut against or otherwise make contact with the first lip 118 and the second lip 121 of the base body 106 of the base 103. The rear surface 156 of the cover 150 may include a recess 159, such as an L-shaped recess, configured to couple the cover 150 to the base 103 and, for example, retain the first lip 118 and the second lip 121 of the base body 106 therein. Thus, the recess 159 (e.g., an L-shaped recess) may be sized and positioned to form a snap connection by forcing the first lip 118 and the second lip 121 into the recess 159 (e.g., the L-shaped recess). As such, in embodiments in which the recess 159 is an L-shaped recess, the L-shaped recess may have to include a height, width, and depth substantially similar to that of the first lip 118 and the second lip 121 to form an interference fit, friction fit, and/or a snap connection therewith, as may be appreciated. Further, the base 103 and/or the cover 150 may be formed of aluminum, stainless steel, plastic, or a combination thereof.

Figure 10:
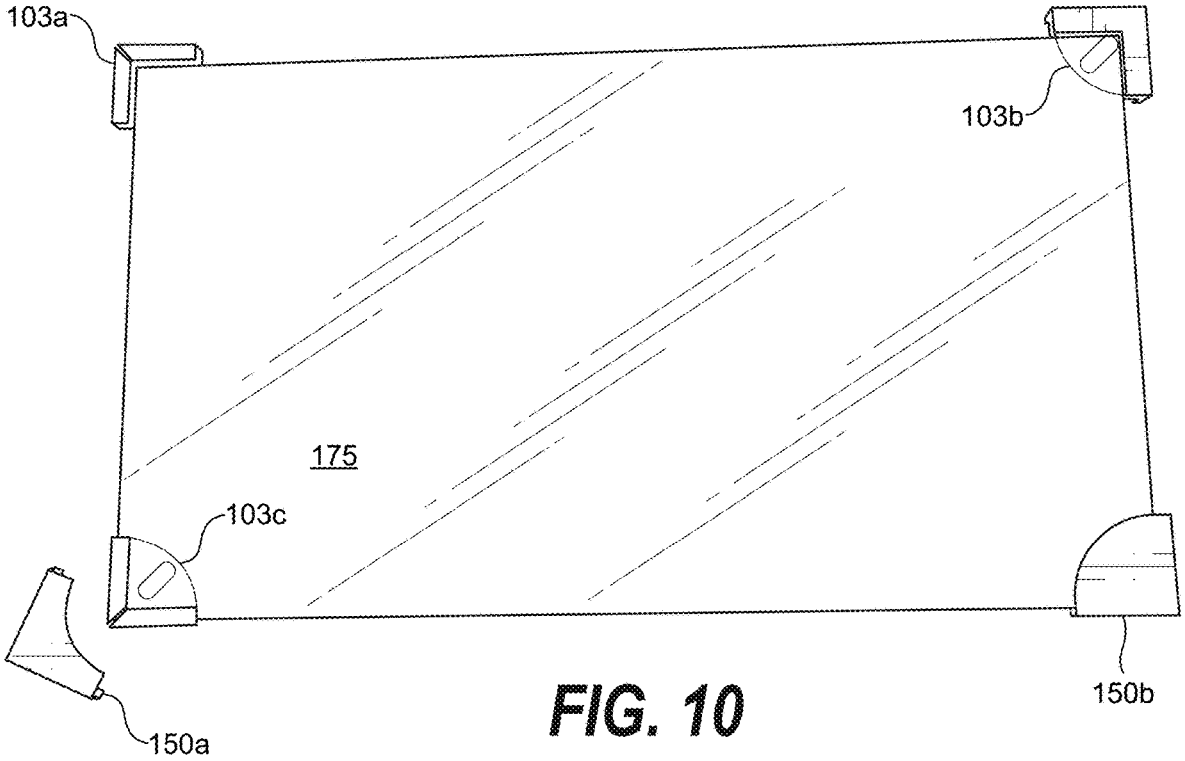
FIG. 10 is a perspective view of a base and a cover of the wall-mounting corner shown relative to a decorative item to be secured to a wall or other surface in accordance with various embodiments of the present disclosure.
Figure 11:
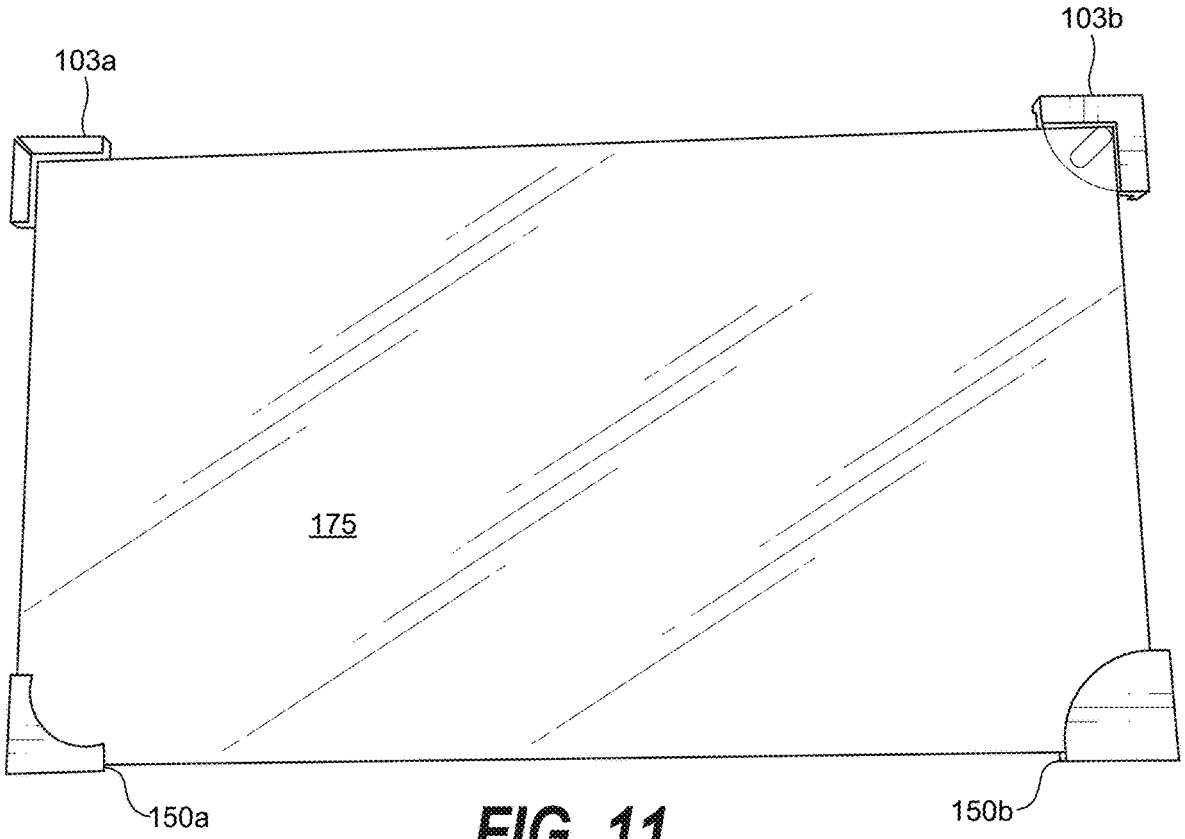
FIG. 11 is another perspective view of a base and a cover of the wall-mounting corner shown relative to a decorative item to be secured to a wall or other surface in accordance with various embodiments of the present disclosure.

FIGS. 10 and 11 are perspective views of multiple ones of the wall-mounting brackets 100, each having the base 103 and the cover 150 of the wall-mounting corner shown relative to a decorative item 175 to be secured to a wall or other surface in accordance with various embodiments of the present disclosure. The decorative item 175 may include one of a decorative glass item, a painting, and a mirror, or other suitable decorative items as may be appreciated.

The wall-mounting bracket 100 described above may be one of a plurality of wall-mounting brackets 100, for example. Although only three bases 103*a*-103*c* of the wall-mounting brackets 100 are shown in FIGS. 10 and 11, there may be four of the wall-mounting brackets 100 with four bases 103 and four covers 150, or other numbers depending on the number of corners of the decorative item 175. As shown in FIGS. 9 and 10, the covers 150*a*-150*b* may be decorative and thus, may have varying designs, colors, materials, textures, or other options, as may be appreciated.

Now, installation of the wall-mounting brackets 100 and the decorative item 175 is described. First, a base 103 of a first bottom one of the plurality of wall-mounting brackets 100 is secured to a wall or other surface by positioning a first screw (or other device, such as a bolt or a nail) through the aperture 145 of the base body 106 of the first bottom one of the plurality of wall-mounting brackets 100. Next, a base 103 of a second bottom one of the plurality of wall-mounting brackets 100 is secured to the wall by positioning a second screw (or other device, such as a bolt or a nail) through the aperture 145 of the base body 106 of the second bottom one of the plurality of wall-mounting brackets 100.

A base 103 of a first top one of the plurality of wall-mounting brackets 100 is then secured to the wall by positioning a third screw through the aperture 145 of the base body 106 of the first top one of the plurality of wall-mounting brackets 100. Similarly, a base 103 of a second top one of the plurality of wall-mounting brackets 100 is secured to the wall, for instance, by positioning a fourth screw through the aperture 145 of the base body 106 of the second top one of the plurality of wall-mounting brackets 100.

Next, the decorative item 175 may be provided, such as a decorative item 175 having a plurality of corners (e.g., four corners). Then, the base 103 of the first and second top ones of the plurality of wall-mounting brackets 100 may be slid along the third screw and the fourth screw, respectively, such that the first and second top ones of the plurality of wall-mounting brackets do not interfere with installation of the decorative item 175. For instance, the third screw and the fourth screw may be slid along the aperture 145, which may be elongated to permit the sliding of the screws or other connection devices.

Bottom ones of the plurality of corners of the decorative item 175 may then be positioned into the base body 106 (and, more specifically, the first lip 118 and second lip 121) of the first and second bottom ones of the plurality of wall-mounting brackets 100, respectively. Finally, the base 103 of the first and second top ones of the plurality of wall-mounting brackets 100 may be slid again along the third screw and the fourth screw, respectively, such that the base 103 of the first and second top ones of the plurality of wall-mounting brackets secure top corners of the decorative item 175 (e.g., by nesting the corners in the first recess 130 and second recess 139, respectively).

Figure 12C:
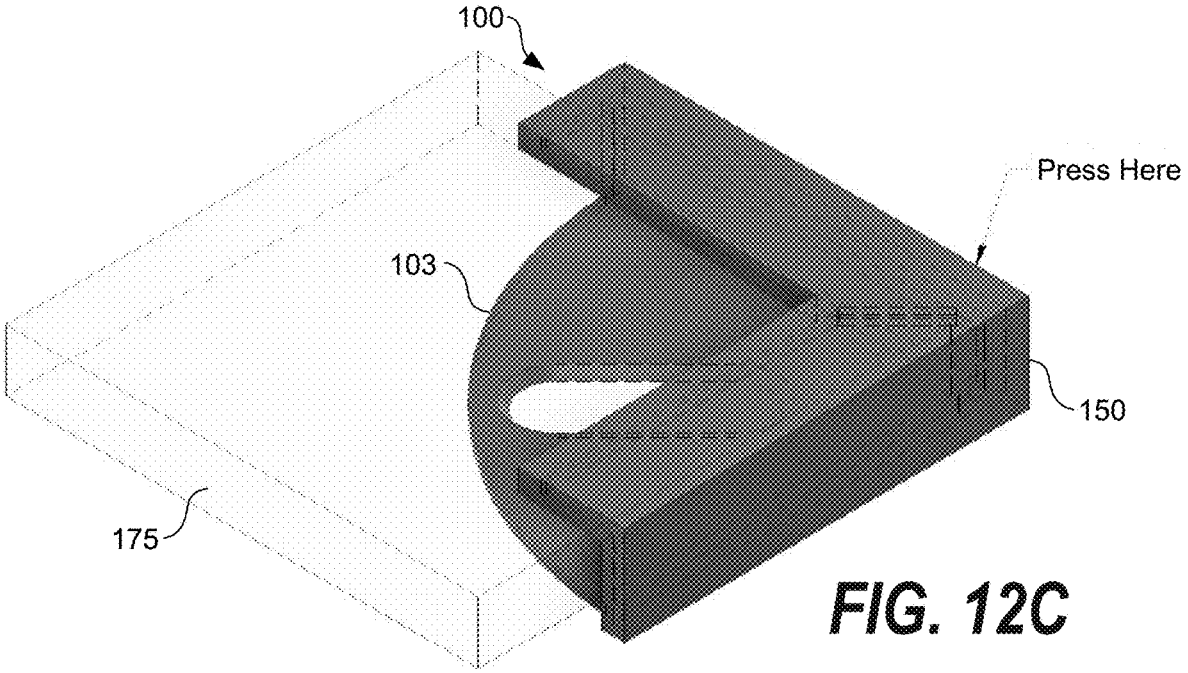

FIGS. 12A-C show an example of attaching a cover 150 to a base 103 of a wall-mounting bracket 100 shown relative to a decorative item 175 to be secured to a wall or other surface in accordance with various embodiments of the present disclosure. First, as shown in FIG. 12A, the base 103 of the wall-mounting bracket 100 may be secured to the wall. Next, as shown in FIG. 12B, the decorative item 175 may be positioned in the base 103 and the distal ends of perpendicular members of the cover 150 of the wall-mounting bracket 100 may be pressed or otherwise secured to the base 103. Finally, as shown in FIG. 12C, a corner of the cover 150 may be pressed to form a snap connection between the cover 150 and the base 103.

Based on the foregoing, a method is described that includes providing a wall-mounting bracket 100 comprising a base 103 having a base body 106, where the base body 106 includes a back plate 109 configured to be positioned against a wall; a first bend 124 from the back plate 109 and a second bend 127 from the back plate 109 defining a first recess 130 for receiving a first side of a decorative item 175 to be secured to the wall, and defining a first lip 118 for retaining the first side of the decorative item 175; and a third bend 133 and a fourth bend 136 defining a second recess 139 for receiving a second side of the decorative item 175 to be secured to the wall, and defining a second lip 121 for retaining the second side of the decorative item 175. In some embodiments, the second recess 139 is perpendicular to the first recess 130. Further, the wall-mounting bracket 100 as provided may include an aperture 145, such as an elongated aperture, in the back plate 109 configured to receive a mounting device to secure the base body 106 to the wall.

The wall-mounting bracket 100 may be one of a plurality of wall-mounting brackets 100 provided, which may be four or other suitable number. The method further includes securing the base 103 of a first bottom one of the plurality of wall-mounting brackets 100 to the wall by positioning a first screw through the aperture 145 of the base body 106 of the first bottom one of the plurality of wall-mounting brackets 100; securing the base 103 of a second bottom one of the plurality of wall-mounting brackets 100 to the wall by positioning a second screw through the aperture 145 of the base body 106 of the second bottom one of the plurality of wall-mounting brackets 100; securing the base 103 of a first top one of the plurality of wall-mounting brackets 100 to the wall by positioning a third screw through the aperture 145 of the base body 106 of the first top one of the plurality of wall-mounting brackets 100; and/or securing the base 103 of a second top one of the plurality of wall-mounting brackets 100 to the wall by positioning a fourth screw through the aperture 145 of the base body 106 of the second top one of the plurality of wall-mounting brackets 100.

The method may further include providing the decorative item 175 where, in some embodiments, the decorative item 175 includes a plurality of corners. The method further includes sliding the base 103 of the first and second top ones of the plurality of wall-mounting brackets 100 along the third screw and the fourth screw, respectively, such that the first and second top ones of the plurality of wall-mounting brackets 100 do not interfere with the installation of the decorative item 175. The method further includes positioning bottom ones of the plurality of corners of the decorative item 175 into the base 103 of the first and second bottom ones of the plurality of wall-mounting brackets 100, respectively, and sliding the base 103 of the first and second top ones of the plurality of wall-mounting brackets 100 along the third screw and the fourth screw, respectively, such that the base 103 of the first and second top ones of the plurality of wall-mounting brackets 100 secure top corners of the decorative item 175.

Finally, the method may include attaching a cover 150 that may be detachable by hand without releasing a screw to each of the plurality of wall-mounting brackets 100 through at least one of a friction connection, an interference connection, and a snap connection. The decorative item 175 may include one of a glass item; a painting; and a mirror, or other items as may be appreciated.

The features, structures, or characteristics described above may be combined in one or more embodiments in any suitable manner, and the features discussed in the various embodiments are interchangeable, if possible. In the following description, numerous specific details are provided in order to fully understand the embodiments of the present disclosure. However, a person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims.

The terms "first," "second," etc. are used only as labels, rather than a limitation for a number of the objects. It is understood that if multiple components are shown, the components may be referred to as a "first" component, a "second" component, and so forth, to the extent applicable.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A wall-mounting bracket, comprising:

a base comprising a base body, the base body comprising:

a back plate configured to be positioned against a wall, the back plate comprising a curved portion extending between a top end of the back plate and a bottom end of the back plate;

a first bend and a second bend collectively defining a first recess for receiving a first side of a decorative item to be secured to the wall, and defining a first lip for retaining the first side of the decorative item;

a third bend and a fourth bend collectively defining a second recess for receiving a second side of the decorative item to be secured to the wall, and defining a second lip for retaining the second side of the decorative item, wherein the second recess is perpendicular to the first recess; and an elongated aperture in the back plate and having a recessed lip configured to receive a mounting device to secure the base body to the wall; and a cover detachably attached to the base body through a snap connection, wherein:

the cover is sized and positioned to cover an entirety of the base body;

the cover comprises a rear surface configured to abut against the first lip and the second lip of the base body of the base;

at least a portion of the cover is formed of a material that permits the cover to expand sufficiently to form the snap connection with the base;

the rear surface of the cover comprises an L-shaped recess configured to retain the first lip and the second lip of the base body therein; and the L-shaped recess is sized and positioned to form the snap connection by forcing the first lip and the second lip into the L-shaped recess.

2. The wall-mounting bracket of claim 1, wherein a space exists between the first lip and the second lip permitting expansion of at least one of the first lip or the second lip.

3. The wall-mounting bracket of claim 1, wherein one of the base or the cover is formed of aluminum, stainless steel, plastic, or a combination thereof.

4. The wall-mounting bracket of claim 1, wherein the first lip and the second lip are integral with the base body.

5. The wall-mounting bracket of claim 1, wherein the curved portion of the back plate of the base body comprises a convex curved portion extending between the top end of the back plate and the bottom end of the back plate.

6. A system, comprising:

a wall-mounting bracket comprising:

a base having a base body; and a cover detachably attached to the base body, wherein the cover is sized and positioned to cover an entirety of the base body, wherein the base body comprises:

a back plate configured to be positioned against a wall, wherein the back plate of the base body comprises a curved portion extending between a top end of the back plate and a bottom end of the back plate;

a first bend from the back plate and a second bend collectively defining a first recess for receiving a first side of a decorative item to be secured to the wall, and defining a first lip for retaining the first side of the decorative item;

a third bend and a fourth bend collectively defining a second recess for receiving a second side of the decorative item to be secured to the wall, and defining a second lip for retaining the second side of the decorative item, wherein the second recess is perpendicular to the first recess; and an aperture in the back plate and configured to receive a mounting device to secure the base body to the wall, wherein the cover comprises:

a rear surface configured to abut against the first lip and the second lip of the base body of the base;

at least a portion of the cover is formed of a material that permits the cover to expand sufficiently to form a snap connection with the base;

the rear surface of the cover comprises an L-shaped recess configured to retain the first lip and the second lip of the base body therein; and the L-shaped recess is sized and positioned to form the snap connection by forcing the first lip and the second lip into the L-shaped recess.

7. The system of claim 6, wherein a space exists between the first lip and the second lip permitting expansion of at least one of the first lip or the second lip.

8. The system of claim 6, wherein one of the base or the cover is formed of aluminum, stainless steel, plastic, or a combination thereof.

9. The system of claim 6, wherein the first lip and the second lip are integral with the base body.

10. The system of claim 6, wherein the aperture is an elongated aperture with rounded corners in the back plate and having a recessed lip for securely mounting the base body to the wall.

11. The system of claim 6, wherein the curve portion comprises a convex curve that extends between the top end of the back plate and the bottom end of the back plate.

12. A method, comprising:

providing at least one wall-mounting bracket, each of the at least one wall-mounting bracket comprising:

a base having a base body, the base body comprising:

a back plate configured to be positioned against a wall, wherein the back plate of the base body comprises a curved portion extending between a top end of the back plate and a bottom end of the back plate;

a first bend from the back plate and a second bend collectively defining a first recess for receiving a first side of a decorative item to be secured to the wall, and defining a first lip for retaining the first side of the decorative item;

a third bend and a fourth bend collectively defining a second recess for receiving a second side of the decorative item to be secured to the wall, and defining a second lip for retaining the second side of the decorative item, wherein the second recess is perpendicular to the first recess; and an aperture in the back plate and configured to receive a mounting device to secure the base body to the wall; and a detachable cover:

securing the at least one wall-mounting bracket to the wall;

mounting the decorative item to the wall using the at least one wall-mounting bracket; and attaching the detachable cover of each of the at least one wall-mounting bracket to the base body of the base of a respective one of the at least one wall-mounting bracket through a snap connection, wherein, for each of the at least one wall-mounting bracket, the detachable cover is sized and positioned to cover an entirety of the base body;

the detachable cover comprises a rear surface configured to abut against the first lip and the second lip of the base body of the base;

at least a portion of the detachable cover is formed of a material that permits the detachable cover to expand sufficiently to form the snap connection with the base;

the rear surface of the detachable cover comprises an L-shaped recess configured to retain the first lip and the second lip of the base body therein; and the L-shaped recess is sized and positioned to form the snap connection by forcing the first lip and the second lip into the L-shaped recess.

13. The method of claim 12, wherein:

the at least one wall-mounting bracket comprises a plurality of wall-mounting brackets, a number of the plurality of wall-mounting brackets being four; and the securing the at least one wall-mounting bracket to the wall comprises:

securing the base of a first bottom one of the plurality of wall-mounting brackets to the wall by positioning a first screw through the aperture of the base body of the first bottom one of the plurality of wall-mounting brackets;

securing the base of a second bottom one of the plurality of wall-mounting brackets to the wall by positioning a second screw through the aperture of the base body of the second bottom one of the plurality of wall-mounting brackets;

securing the base of a first top one of the plurality of wall-mounting brackets to the wall by positioning a third screw through the aperture of the base body of the first top one of the plurality of wall-mounting brackets; and securing the base of a second top one of the plurality of wall-mounting brackets to the wall by positioning a fourth screw through the aperture of the base body of the second top one of the plurality of wall-mounting brackets.

14. The method of claim 13, wherein the mounting the decorative item to the wall using the at least one wall-mounting bracket comprises:

providing the decorative item, the decorative item having a plurality of corners;

sliding the bases of the first and second top ones of the plurality of wall-mounting brackets along the third screw and the fourth screw, respectively, such that the first and second top ones of the plurality of wall-mounting brackets do not interfere with installation of the decorative item;

positioning bottom ones of the plurality of corners of the decorative item into the bases of the first and second bottom ones of the plurality of wall-mounting brackets, respectively; and sliding the bases of the first and second top ones of the plurality of wall-mounting brackets along the third screw and the fourth screw, respectively, such that the bases of the first and second top ones of the plurality of wall-mounting brackets secure top ones of the plurality of corners of the decorative item.

15. The method of claim 12, wherein the decorative item comprises a glass item, a painting, or a mirror.

* * * * *